US007491098B1

(12) United States Patent
Pijoan-Parellada et al.

(10) Patent No.: US 7,491,098 B1
(45) Date of Patent: Feb. 17, 2009

(54) SCREWLESS TERMINAL FOR ELECTRICAL LEADS

(75) Inventors: Josep Pijoan-Parellada, Madrid (ES); Eduardo Calleja, Mostoles (ES); Ranjit Manohar Deshmukh, Karnataka (IN); Ranganath Gururaj, Karnataka (IN); Venkatesha Murthy, Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/869,984

(22) Filed: Oct. 10, 2007

(51) Int. Cl.
*H01R 4/48* (2006.01)

(52) U.S. Cl. ..... 439/786; 439/834; 439/835

(58) Field of Classification Search ..... 439/786, 439/834, 835
See application file for complete search history.

(56) References Cited

U.S. PATENT DOCUMENTS 6,682,364 B2 * 1/2004 Cisey ..... 439/441
6,851,967 B2 * 2/2005 Miyoshi et al. ..... 439/441
7,224,140 B2 5/2007 Arefeen et al.
7,252,534 B2 * 8/2007 Reibke ..... 439/404
2008/0085639 A1 * 4/2008 Eppe et al. ..... 439/834

FOREIGN PATENT DOCUMENTS

EP 00908965 A1 4/1999
EP 01152489 B1 1/2003
ES 2239884 A1 10/2005

* cited by examiner

*Primary Examiner*—Tho D Ta

(57) ABSTRACT

According to a preferred embodiment, a terminal for electrical leads comprises a housing, a guide, a current bar, a leaf spring and a moveable operator. The guide is supported by the housing and comprises guide surfaces that connect with at least one surface of the current bar. The leaf spring comprises at least one limb with an offset for clamping a cable to the current bar. Additionally, the terminal comprises a moveable operator dimensioned and configured to allow the release of a cable from contact with the current bar.

9 Claims, 4 Drawing Sheets

SCREWLESS TERMINAL FOR ELECTRICAL LEADS

BACKGROUND OF THE INVENTION

1. Field of the Invention

The subject matter described herein relates generally to a device for screwless fitting of terminal leads in electrical applications, more particularly in circuit breakers.

2. Related Art

Terminals for electrical leads are typically found in various applications including switches and circuit breakers.

Prior art methods of connecting lead wire to the circuit breaker required screwing the wire to the terminal, which resulted in a loss of efficiency. More particularly, it increased the amount of installation time required for connecting wire to circuit breakers. Therefore, screwless terminals such as the one described in U.S. Pat. No. 7,224,140 comprise spring clips that hold electrical leads to the terminal. The spring clips are comprises various shapes including U shapes and are made of flexible material. Currently, a simplified insertion and release mechanism is lacking to connect both flexible and/or hard wires to a terminal.

Accordingly, there is a need to provide an improved terminal for electrical leads to provide for a more efficient installation of devices such as circuit breakers.

SUMMARY OF THE INVENTION

According to one embodiment, a terminal for electrical leads comprises a housing, a guide, a current bar, a leaf spring and a moveable operator. The guide is supported by the housing and comprises guide surfaces that connect with at least one surface of the current bar. The leaf spring comprises at least one limb with an offset for clamping a cable to the current bar. Additionally, the terminal comprises a moveable operator dimensioned and configured to allow the release of a cable from contact with the current bar.

DETAILED DESCRIPTION OF THE INVENTION

One embodiment of the present inventions concerns a screwless terminal arrangement for connecting rigid or flexible electric wires to a circuit breaker.

Figure 1:
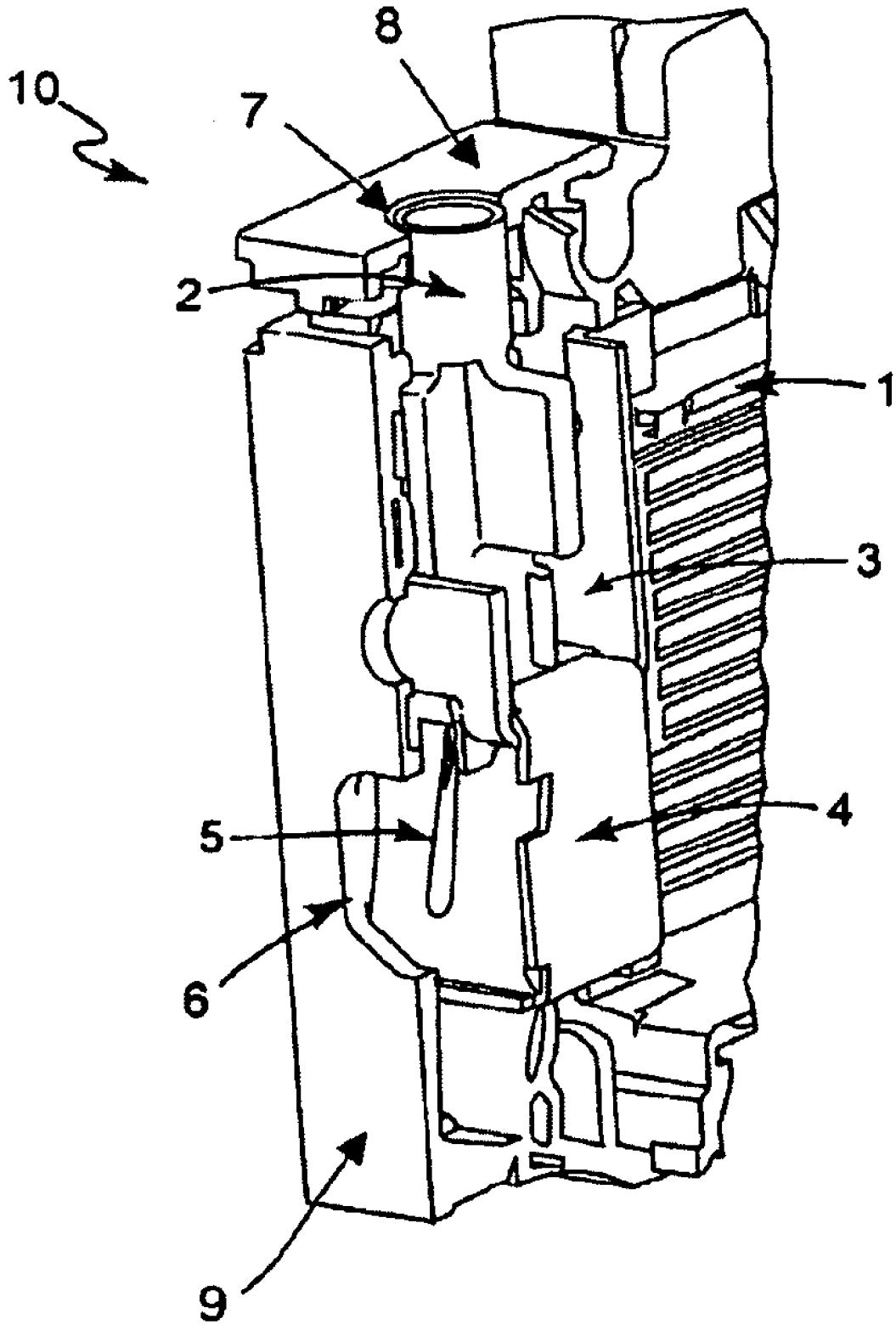
FIG. 1 is a perspective view of a modular electric device as per the invention, has a screwless cable terminal arrangement.

Referring now to FIG. 1, a circuit breaker in accordance with one embodiment of the present invention is illustrated generally at 10. The circuit breaker 10 is shown as having an insulation housing 1 containing an operating element 2. The insulation housing 1 is provided with at least one terminal compartment 4, in which is disposed a current bar 3, and a clamping spring 5.

In one embodiment of the invention, the housing 1 is constructed of an injection-molded polymer. Additionally, the housing 1 comprises a rectangular shape with a cavity for holding the components of the circuit breaker 10. The housing contains a surface 8 with an aperture 7 to allow the push-in surface of the operator 2 to project out of the housing 1 to enable an installer to press it in order to insert or release a cable 50 from the hold of the leaf spring 5. Similarly, the housing 1 has a surface 9 with an aperture 6 for insertion of the cable 50 into the circuit breaker that is perpendicular to the surface 7 wherein the aperture for the operator 2 is located. The surface 9 comprises a single aperture 6 that allows the insertion of one cable 50 into the circuit breaker. Alternately, the surface 9 comprises two separate apertures that can receive a single cable 50 each. The housing 1 further contains a flat surface area within the cavity of the housing 1 onto which the terminal flange 20 will anchor. Furthermore, the housing cavity has a base surface that supports the guide 4.

Figure 2:
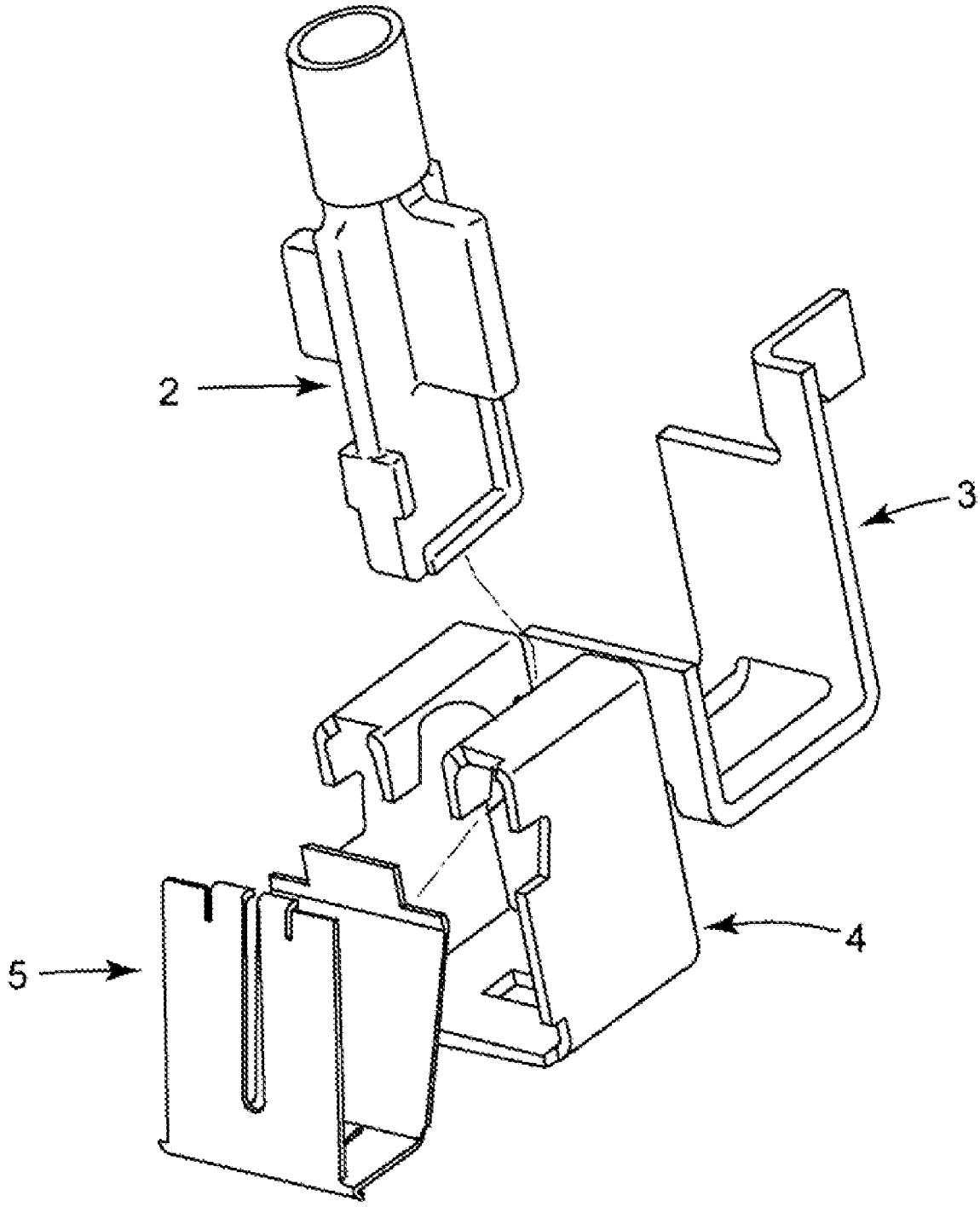
FIG. 2 is an exploded view of the screwless cable terminal components.

Referring now to FIG. 2, the components of the screwless terminal are shown in an exploded view.

Figure 3:
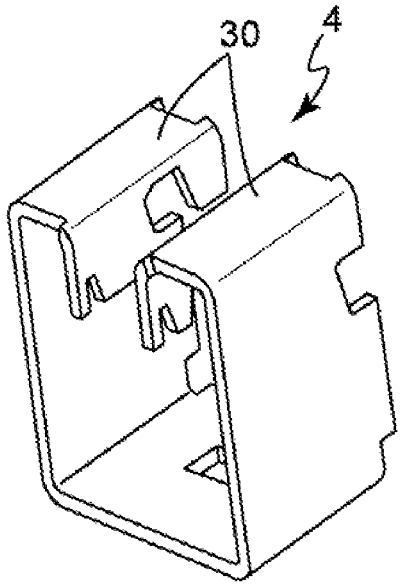
FIG. 3 is a perspective view of the guide.

Referring now to FIG. 3, the guide or terminal compartment 4 is shown. The terminal compartment 4 acts as a support and/or guide for the electric wires that are inserted through the housing 1. The guide has two outer surfaces 30 that are configured to interlock with the current bar 3. The outer surfaces 30 guide the operator 2 to the leaf spring. The base surface has an aperture for holding with the leaf spring 5. The guide 2 can be made of any resilient material and is substantially rectangular in shape.

Figure 4:
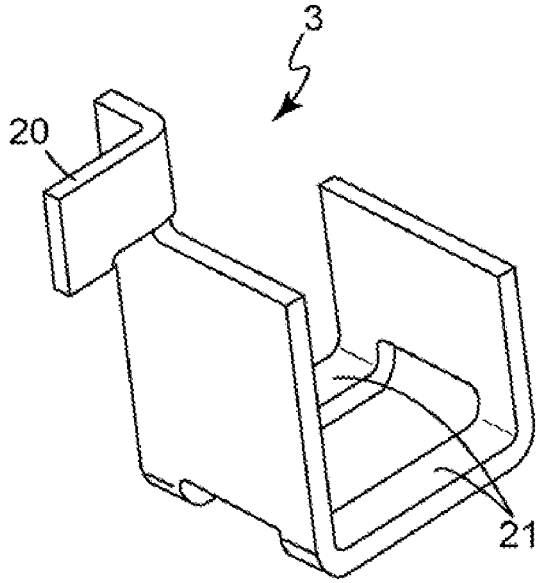
FIG. 4 is a perspective view of the current bar.

Referring now to FIG. 4, the current bar 3 is shown. The current bar 3 is a component that forms a current path from an externally inserted wire 50 to the inner portion of the circuit breaker. The current bar 3 has surfaces 21 for connecting to the electric wire 50. One embodiment of the invention includes a current bar 3 that is substantially rectangular in shape with the base having an aperture through which the operator 2 moves to make contact with the spring 5. Furthermore, the current bar 3 includes two surfaces that interconnect with two surfaces of the guide 4. The current bar 3 further comprises a flange 20 that anchors to the housing 1. Additionally, the current bar 3 comprises a conductive, resilient material.

Figure 5:
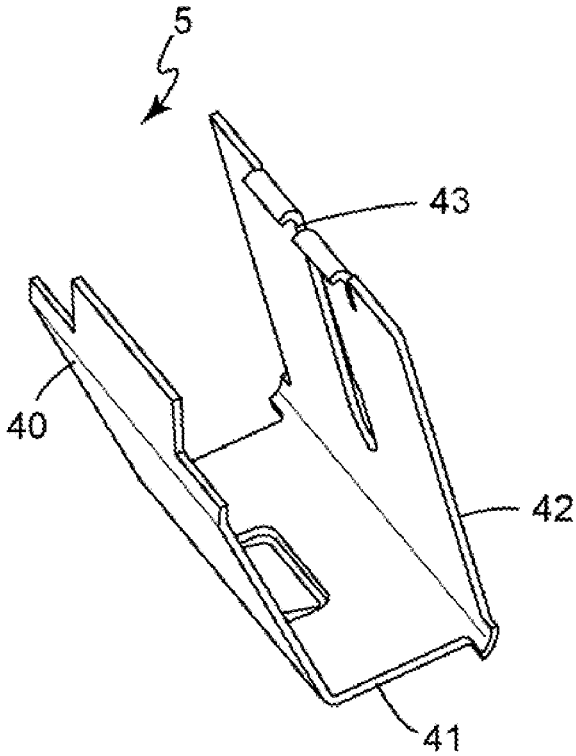
FIG. 5 is a perspective view of the leaf spring.

Referring now to FIG. 5, the spring element 5 is depicted as a flat leaf spring angled in such a position to facilitate easy insertion and self-locating of the cable 50 while inserting the cable 50 in the opening 6 provided on the circuit breaker. The spring 5 leaf can have a U-shape with a base 41, a side 40 comprising an angled tab to interlock with the fixed terminal 4, and two clamping limbs 42. The spring element 5 can be angled to allow the free end of its clamping leg 42 to form a curved flange, that serves as a clamping edge 43 for holding the electric wire 50 inserted in the connection position as well as a surface for contact with the operating mechanism 2 for re-opening the terminal. Additionally, the free end of the spring element 5 exerts sufficient pressure to hold the inserted cable 50 against the terminal 4 to allow for the current flow. The spring 5 is designed to hold a single cable 50 in place when connecting a second, rigid cable 50 by pushing towards the terminal 4. The previously inserted rigid or flexible cable 50 will be continuously clamped by the spring 5 and will not come out.

Figure 6:
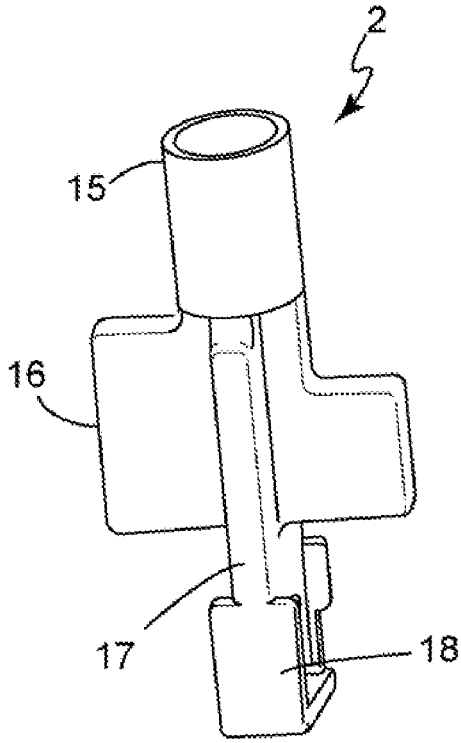
FIG. 6 is a perspective view of the operator.

Referring now to FIG. 6, the operator 2 is a component required for cable 50 release during re-opening of the terminal 4 connection. The operator has wing-like flanges 16, 17 that guide the operating member 2 to move in a vertical direction while arresting other degrees of freedom. The operating element 2 is operated with a push-in action. An embodiment of the invention includes an operator 2 that is a solid component. The operator can include two rectangular flanges 16 that span perpendicular to another set of flanges 17 of a lesser width to which a foot portion 18 is connected and comprises the bottom surface of the operator 2. The foot portion comprises two perpendicular surfaces that are wider than the portion of the operator 2 to which they are connected. The bottom surface of the operator 2 engages the leaf spring limbs 42.

To insert a rigid cable 50, the installer can push the exposed, rigid cable 50 through the aperture 6 towards the current bar 3. The installer can press the operating mechanism/release button 2 and pull the cable 50 to release the cable 50. When a flexible cable 50 is used for insertion, an installer will be required to push the exposed portion of the flexible cable 50 towards the terminal 4 by pressing the operating mechanism/release button 2. The installer will be required to press the operating mechanism 2 and pull the cable 50 to release the cable 50 from the terminal 4.

Figure 7:
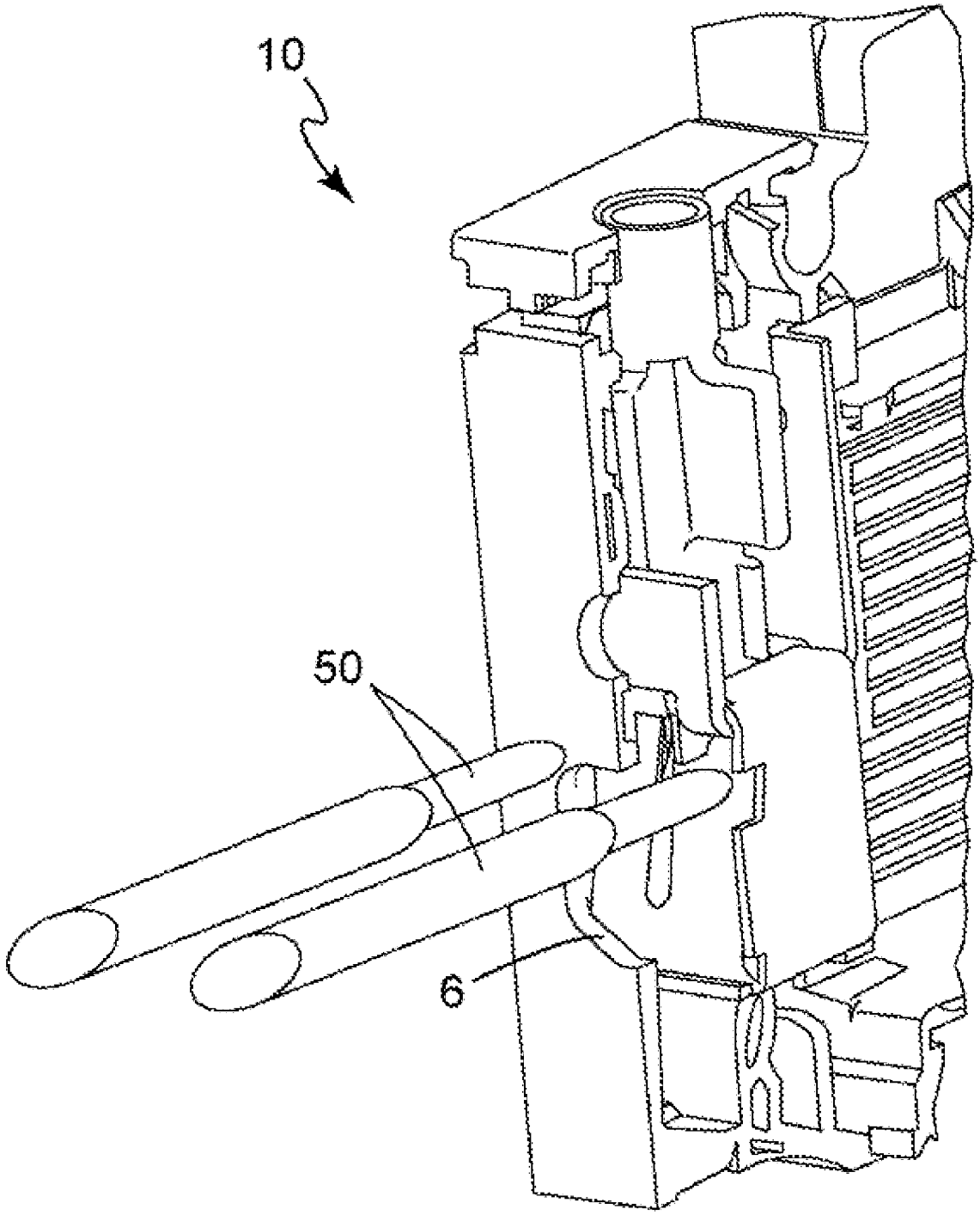
FIG. 7 is a perspective view of the one embodiment of the invention during cable inserting condition.

Referring now to FIG. 7, a view of an embodiment of the invention is shown in relation to wires 50 ready for insertion into terminal 4 through aperture 6.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A terminal for electrical leads comprising:

a housing;

a guide supported by the housing and comprising stationary guide surfaces;

a current bar interconnected with the guide and comprising at least one contact surface;

a leaf spring comprising at least one limb biased proximal to the at least one contact surface; and a moveable operator dimensioned and configured to engage the leaf spring whereby the at least one limb moves in a direction distal to the contact surface.

2. The terminal of claim 1, wherein the guide comprises two surfaces configured to direct the operator to the leaf spring.

3. The terminal of claim 1, wherein the terminal comprises a flange that anchors to the housing.

4. The terminal of claim 1, wherein the leaf spring is comprises at least one clamping limb with a single, curved flange for contact with the operator.

5. The terminal of claim 4, wherein the leaf spring is comprises two clamping limbs.

6. The terminal of claim 1, wherein the terminal and leaf spring are formed together.

7. The terminal of claim 1, wherein the operator comprises wing-like projections that guide the operator to move in a vertical direction.

8. The terminal of claim 1, wherein the housing consists of a circuit breaker casing.

9. The terminal of claim 1, wherein the terminal and guide are formed as one piece.

* * * * *